US005607255A

United States Patent [19]

Thomas et al.

[11] Patent Number: 5,607,255

[45] Date of Patent: *Mar. 4, 1997

[54] METHOD OF MILLING TO FORM HIGHWAY DEPRESSIONS

[76] Inventors: Glen E. Thomas; Amona D. Thomas, both of P.O. Box 1083, Moore Haven, Fla. 33471

[ * ] Notice: The term of this patent shall not extend beyond the expiration date of Pat. No. 5,391,017.

[21] Appl. No.: 513,355

[22] Filed: Aug. 10, 1995

Related U.S. Application Data

[63] Continuation-in-part of Ser. No. 391,708, Feb. 21, 1995, which is a continuation-in-part of Ser. No. 118,961, Sep. 10, 1993, Pat. No. 5,391,017.

[51] Int. Cl.[6] ..... E01C 23/09

[52] U.S. Cl. ..... 404/90; 404/72; 404/93; 404/94

[58] Field of Search ..... 404/72, 90, 93, 404/94; 299/38, 39

[56] References Cited

U.S. PATENT DOCUMENTS

| | | | |
|---|---|---|---|
| 3,094,047 | 6/1963 | Patton | 404/94 |
| 3,807,634 | 4/1974 | Vogt | 239/150 |
| 4,701,069 | 10/1987 | Whitney | 404/75 |
| 4,744,604 | 5/1988 | Lewis et al. | 299/10 |
| 4,793,732 | 12/1988 | Jordon | 404/90 |
| 4,797,025 | 1/1989 | Kennedy | 404/90 |
| 4,824,516 | 4/1989 | Ishihara et al. | 156/523 |
| 4,896,995 | 1/1990 | Simmons | 404/90 |
| 4,900,094 | 2/1990 | Sergeant | 299/39 |
| 4,938,537 | 7/1990 | Rife, Jr. et al. | 299/39 |
| 4,943,199 | 7/1990 | Hillen | 414/313 |
| 4,986,604 | 1/1991 | Meister | 299/39 |
| 5,046,890 | 10/1991 | Dickson | 404/90 |
| 5,059,061 | 10/1991 | Stenemann et al. | 404/72 |
| 5,094,565 | 3/1992 | Johnson | 404/75 |
| 5,161,910 | 10/1992 | O'Konek | 404/90 |
| 5,259,692 | 11/1993 | Beller et al. | 404/90 |
| 5,297,894 | 3/1994 | Yenick | 404/90 |
| 5,391,017 | 2/1995 | Thomas et al. | 404/90 |
| 5,415,495 | 5/1995 | Johnson | 404/84.05 |

*Primary Examiner*—Henry A. Bennett
*Assistant Examiner*—Pamela A. O'Connor

[57] ABSTRACT

The forming of sonic noise alert pattern, (SNAP), type depressions using a milling through procedure. A cutting head, having a smaller diameter than would fit the resultant depression, is used. Elevational control of the cutting head is regulated by passage across the surface under treatment. Repetitive cycling of this elevational control is used to install a series of depressions. The elevational control results in a gradual lowering and gradual raising of the cutting head. During cutting a significant longitudinal distance is traveled by the cutting head. Cam wheels are disclosed for providing the elevational control. Various transfer means are discussed to transfer the elevational control to the cutting head. These include direct transfer and reverse transfer. Proportional transfer is explained with examples given. Example machines are detailed capable of practicing the invention.

17 Claims, 11 Drawing Sheets

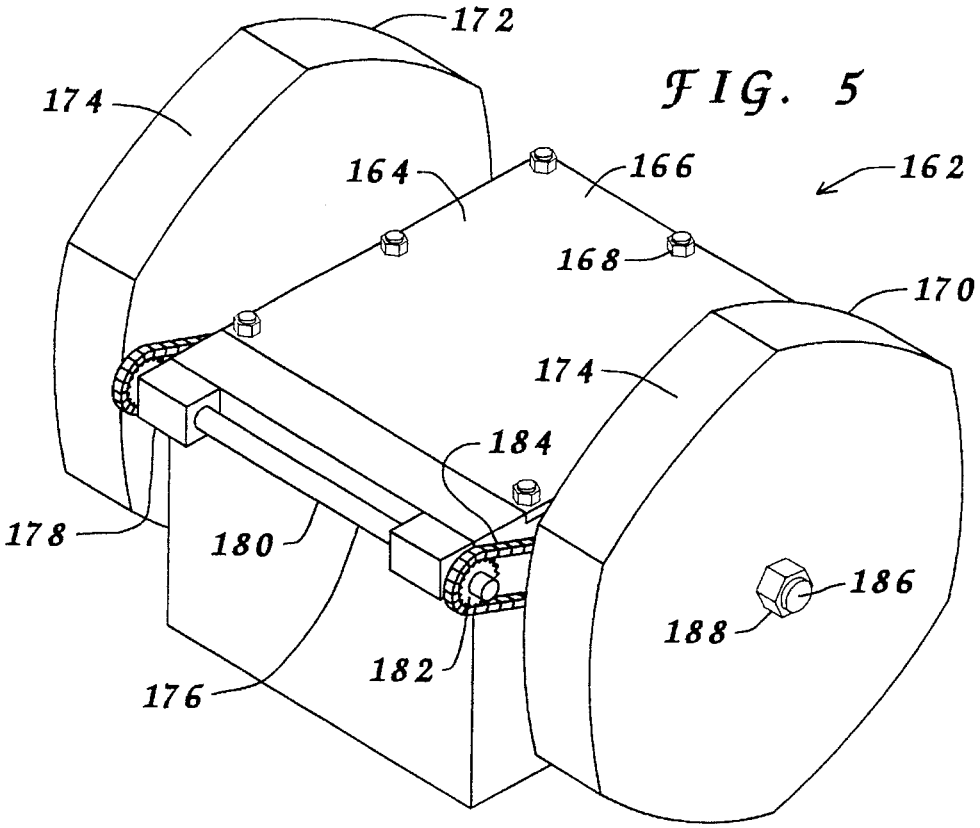
FIG. 5
FIG. 6
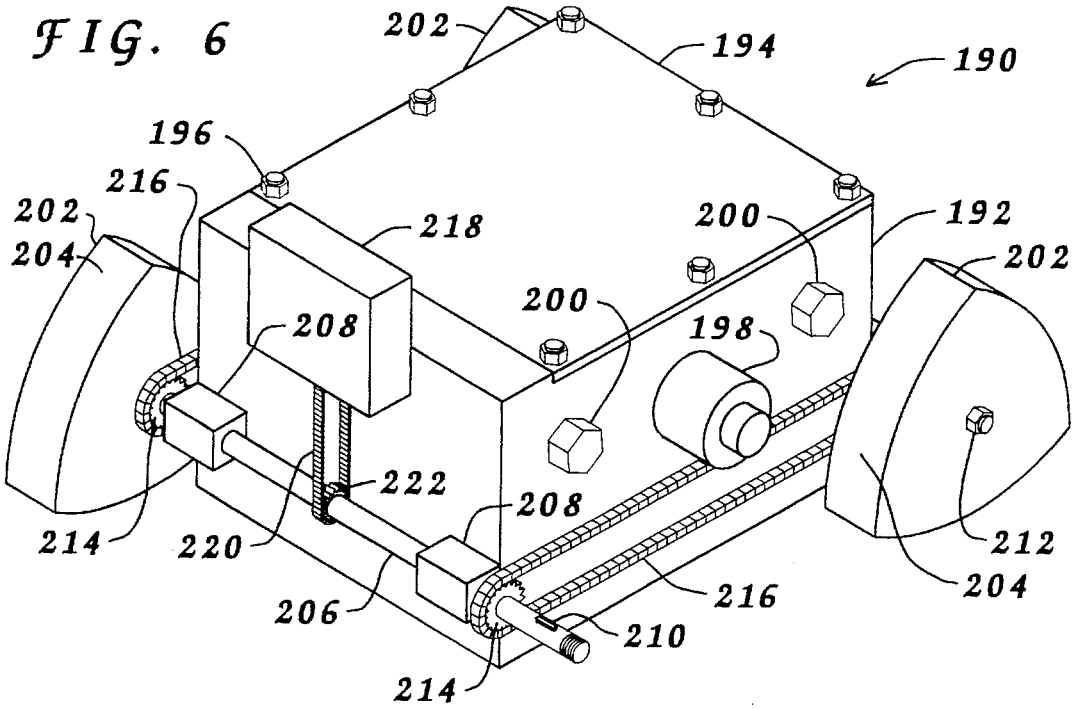

METHOD OF MILLING TO FORM HIGHWAY DEPRESSIONS

CROSS-REFERENCES

This application is a continuation-in-part application of U.S. Ser. No. 08/391,708, filed Feb. 21, 1995, entitled "Continuous Moving Highway Depression Cutting", currently pending; which is a continuation-in-part application of U.S. Pat. No. 5,391,017, Ser. No. 08/118,961, filed Sep. 10, 1993, entitled "Continuous Moving Depression Cutting Tool for Highway Use". This application is related to application Ser. No. 08/179,672 filed Jan. 11, 1994, entitled "Cutting of Repetitive Depressions in Roadway Surface". This application is related to application Ser. No. 08/471,858, filed Jun. 6, 1995, entitled "Impact Formed Depressions and Installation Machine".

BACKGROUND

1. Field of the Invention

Generally the invention relates to forming milled depressions in an asphalt road surface. More specifically the invention relates to forming shallow depressions in a milling through operation by propelling a cutting head forward while in contact with the asphalt surface while regulating a lowering and raising motion.

2. Description of the Prior Art

Sonic noise alert pattern, (SNAP), are a series of shallow depressions formed in the surface of asphalt roads. The pattern has the purpose of providing vibration and noise when the tires of a vehicle traverse them longitudinally. Road departments use these depressions as a safety device. Longitudinally adjacent the edge of a highway or along the center line which divides the opposing directional traffic flows are common locations of placement. They act to alert a driver that his or her vehicle has extended beyond the normal driving surface. Beyond this normal driving surface many dangerous conditions exist for a vehicle traveling near the posted speed limit. These dangers include, amongst others, dirt or gravel shoulders, guardrail barriers, signs, mailboxes, intersecting roadways or driveways and stationary vehicles. Limited access highways and rural roads are likely locations for SNAP depressions to be installed due to the fatigue that a driver experiences during extended driving on such roads.

The various specifications for the physical dimensions of the individual depressions and their respective placement can vary from state to state and even within a particular state. A common size and placement, used only for illustration and not limitation, places the individual depressions twelve inches apart from center of one depression to center of each adjacent depressions. The measurements of the individual depressions being seven inches from back trailing edge to front leading edge with a depth, at the deepest point, of one half inch and a lateral length across of sixteen inches. These specifications result in five inches of uncut surface between each set of adjacent depressions. Therefore, the above specifications would require fifty-two hundred and eighty cuts per mile.

A recent innovation in the specifications for the installation of SNAP type depressions requires a skip pattern to be incorporated within the series. One example of such a series has eight depressions spaced as detailed above followed by an uncut area equal to the normal placement of four depressions. Such installation affords reasonable coverage of a highway while reducing installation expense. Limited access highways and rural roads are likely locations for SNAP depressions to be installed due to the fatigue that a driver experiences during extended driving on such roads.

Conventional installation of SNAP type depressions utilize at least one rotary cutting head with a plunge cut from a stationary position. Following the stationary plunge cut the machine is advanced, paused and the cutting procedure repeated. This action is repeated in a repetitive manner along the desired path of the series.

Various attempts have been made to provide a machine capable of quickly, accurately, consistently and precisely installing SNAP type depressions. These attempts have been less efficient than desired. As such, it may be appreciated that there continues to be a need for a method of forming SNAP type depressions using a milling through operation. And for a method which can consistently form depressions in a continuous, non pausing, manner having precise placement and precise dimensions. The present invention substantially fulfills these needs.

SUMMARY

In view of the foregoing disadvantages inherent in the known types of machines to install SNAP depressions, your applicants have devised a method of forming depression without requiring a plunge cut to be made. This method regulates the lowering and raising of a rotary cutting head during advance of the machine. The method provides for a significant longitudinal advance of the cutting head while it is in contact with the asphalt surface.

At least one camming group is incorporated on the periphery of the cam member. Each camming group would have a minimum relative height contact position and a maximum relative height contact position. These opposing positions place the axis line of the cam member at opposing ends of an elevational range of motion. During usage the cam member would be either in constant contact or indirect communication with the surface under treatment. The cam member would rotate based on the passage of the machine over the surface under treatment. The axis line would transfer the repetitive lowering motion and raising motion to the cutting head.

The cam member causes the cutting head to move downward, and into contact with the surface to begin cutting a depression, and to move upward, and out of contact with the surface to end cutting of the depression. Uniform spacing of the depressions result from the actual tracking by the cam member of the surface under treatment. A resulting transference of the desired pattern to the surface is accurately assured.

One method uses at least one cam wheel and a pivot point. The cam wheel would most likely be positioned in front of the cutting head. This placement affords contact with the surface under treatment without undue concern of contamination by debris caused by the milling operation. The opposing positioning is viable if care is taken to provide contact with the true surface as compared to debris. The pivot point would be located in front of the cam wheel and the cutting head, between the cam wheel and the cutting head or behind the cam wheel and the cutting head. The pivot point would either be an assembly directly in contact with the surface under treatment or a position attached to the transport vehicle. The cam wheel pivotally causes the raising and lowering of the cutting head into and out of contact with the surface under treatment.

A second method places two identical synchronized cam wheels on the opposite lateral sides of the cutting head. Here they would carry the cutting head chariot style while providing the required camming action.

A third method places cam members on the opposing ends of the cutting head in front of and behind the cutting head based on the orientation of the direction of travel of the machine.

A fourth method moves the camming member out of direct contact with the surface under treatment. This method preferable provides rotation of the camming member relative to the passage of the machine over the surface under treatment.

The rotational profile of a cam wheel will have at least one camming group as detailed elsewhere. Each camming group's rotational profile will have a maximum radial distance and a minimum radial distance. Both distances are measured from the axis line of the cam wheel to the contact point of the rotational profile with the surface under treatment. Two possible rotational modes exist for cam wheels. One mode places the maximum radial distance position and the minimum radial distance position in contact with the surface under treatment at, or nearly at, the same time during rotation. This causes a pivoting from the maximum radial distance position of one camming group to the maximum radial distance position of the following camming group. This orientation provides for a gradual lowering of the axis line as it advances. This gradual lowering is followed by a sudden change in direction upward to be followed by a gradual raising. This is followed by a gradual, smooth, transition into the gradual lowering of the axis line. The second mode is exampled by curved surfaces on the cam wheel, with a rolling through from the maximum radial distance location to the minimum radial distance location. This orientation provides for smooth transition from the lowering to the raising motions as well as from the raising to the lowering motions of the axis line.

The first mode affords a greater range of motion than the second mode due to the bottoming out, with the resulting sudden change in direction. Using the reverse transfer method this mode permits milling through the cut when the pivot point is placed between the camming wheel and the rotary cutting head.

The second mode, while limiting the elevational range of motion, permits milling through the cut while the rotary cutting head advances forward with the machine using any of the transfer methods. As with all the milling through methods a rotary cutting head having a smaller diameter than would otherwise fit the resulting depression is required. Because grinding occurs during a distance of the forward motion of the mill through method a smooth action results.

Incorporation of a skip pattern within the series would be easy to implement. Select camming groups on the periphery of the cam wheel would not transfer a lowering action to the rotary cutting head. Such selective elimination would provide accurate resumptions of the series while eliminating lowering of the rotary cutting head during the passage of this section. A second method of incorporating a skip pattern within the series is to either elevate the cutting head during passage of the skip section or otherwise block the lowering action during such passage.

The specific cam wheel would have at least one camming group. The rotational profile of the cam wheel will have a circumferential measurement. The circumferential measurement is the rolling distance from a select point on the cam wheel through one complete rotation to the same point. This measurement will be equal to the number of camming groups multiplied by the longitudinal spacing of the resulting depressions. Based on the specification for installation, including spacing between adjacent depressions and the required depth of the depression, large cam wheels, having many camming groups, are possible. The range of elevation required to provide the proper depth of cut and to provide for clearance of the uncut spacing area between cuts is an important consideration. Placement of the cam wheel between the pivot point and the rotary cutting head, due to the exaggerated transfer, will allow usage of large cam wheels having many camming groups.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposed of the present invention. It is important, therefore, that the claims be regarded as including such equivalent constructions insofar as they do not depart from the spirit and scope of the present invention.

The primary object of the present invention is to provide for milling through the depression cut utilizing cam regulation to lower and raising the milling tool while the milling tool is advanced longitudinally.

Other objects include;

a) to provide a method to precisely install SNAP depressions in a consistent and uniform manner.

b) to provide a machine to precisely install SNAP depressions in a consistent and uniform manner.

c) to provide for the continuous forming of SNAP depressions without requiring pausing the machine during such installation.

d) to permit operation of the machine by operators having ordinary skill with such equipment without requiring repetitive precision placement of the machine.

e) to provide for simple accurate incorporation of skip patterns within the series of installed SNAP depressions.

f) to provide for various placements of the pivot point to control the transfer of the camming action of the cam member to the rotary cutting head.

g) to provide an eccentric wheel assembly, having a generally round wheel and an axle which is offset from the wheel's actual center, to generate the camming action.

h) to provide a cam wheel having a plurality of camming groups to generate the camming action.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 2 is a perspective view of a series of installed SNAP type depressions having a skip pattern incorporated there in.

FIG. 5 is a perspective view of another embodiment of a cutting assembly.

FIG. 6 is a perspective view of yet another embodiment of a cutting assembly.

DESCRIPTION

Figure 1:
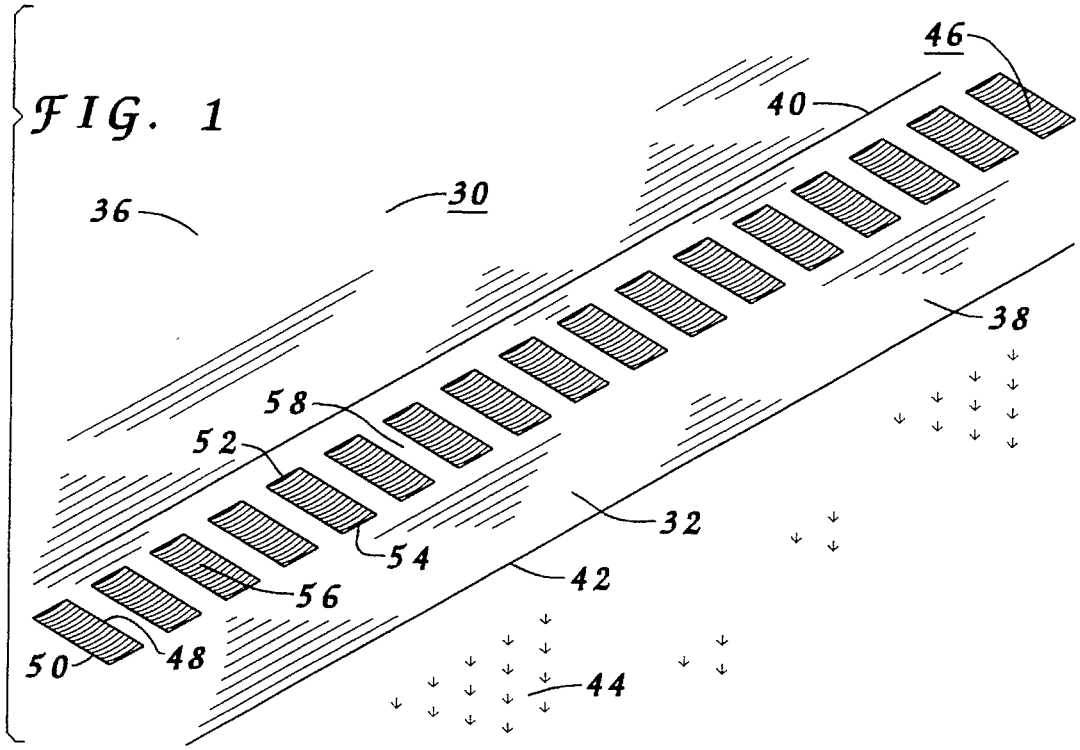
FIG. 1 is a perspective view of a series of installed SNAP type depressions.
Figure 2:
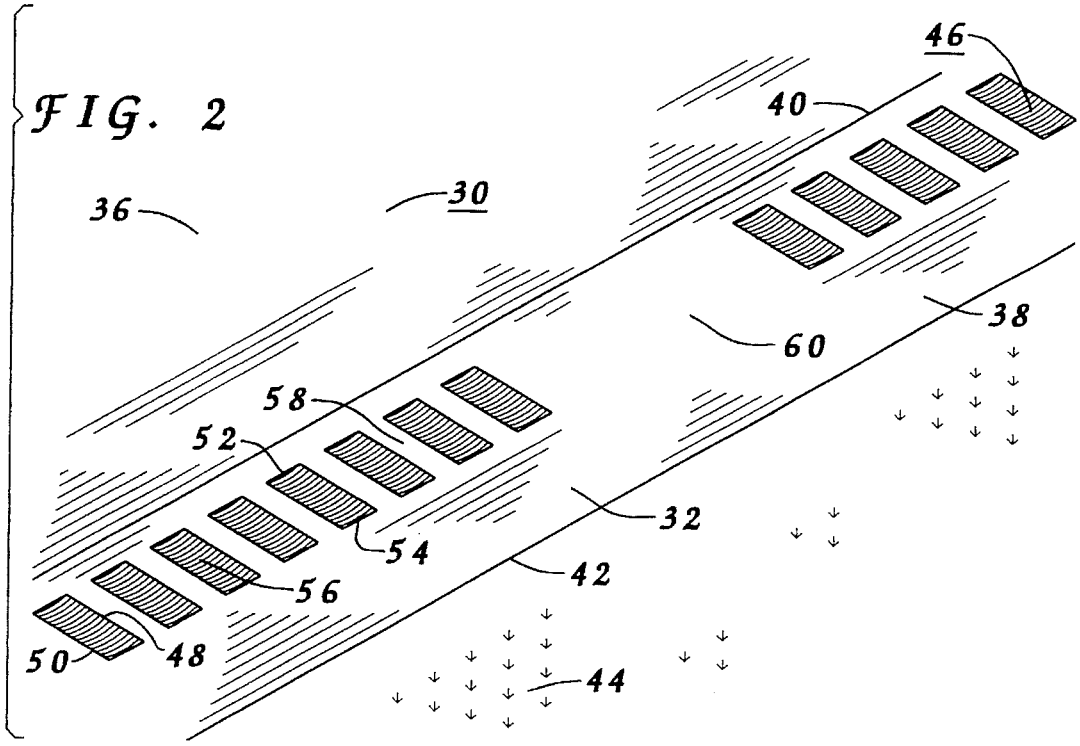

Referring now to the drawings where like reference numerals refer to like parts throughout the various views, and specifically referring to FIG. 1 and FIG. 2. Many different configurations exist for SNAP depressions, with an example set shown in FIG. 1, which is illustrated as an example, and not a limitation. The example specifications are recited below, with the understanding that the machines depicted in FIG. 3 through FIG. 6 are adaptable to install the example series shown in FIG. 1. Throughout the views various axles are identified and it is understood that each axle representing an axis line.

Various specifications are possible for SNAP depressions. Two such examples are depicted in FIG. 1 and FIG. 2. A roadway 30, formed of asphalt 32, is separated into two distinct areas by a side marking line 40. These two areas are a driving surface 36 and an extended edge 38. Roadway 30 is separated from a shoulder 44 by an edge of pavement 42.

In FIG. 1 extended edge 38 has installed therein a series of seventeen depressions 46 while FIG. 2 has installed therein thirteen depressions 46. Each depression 46 has a first edge 48 and a second edge 50. These edges 48 and 50 are relatively perpendicular to edge of pavement 42 and each is transitional, gradually sloping into depression 46. Each depression 46 further has a first side 52 and a second side 54. These sides 52 and 54 are relatively parallel to edge of pavement 42. Each depression 46 has a center of cut 56 which extends from the about the middle of the base of first side 52 to about the middle of the base of second side 54 and is of a relatively even depth measured from the plane formed by the surrounding asphalt The shading depicted within each depression 46 is for illustrative purposes to depict a curved shape. A separating strip 58 separates each adjacent set of depressions 46. Separating strip 58 is an area of uncut asphalt The example SNAP depressions have a length, measured from first edge 48 to second edge 50 of approximately seven inches, a width, measured from first side 52 to second side 54 of approximately sixteen inches and a depth, measured at center of cut 56, of approximately one half inch. Each adjacent set of depressions, with the exception of skip section 60 shown in FIG. 2, are separated by approximately five inches of uncut asphalt 32. Therefore each adjacent set of depressions 46 in a continuous series are spaced apart, measured from center to center, approximately twelve inches. The continuous pattern illustrated in FIG. 1 would require approximately fifty two hundred and eighty, (5280), outs per mile of installation.

FIG. 2 depicts a series of depressions 46 in a skip pattern configuration. Skip section 60 is inserted in a repetitive cycle. Rather than continuous installation, a predetermined repetitive cycle of cuts are eliminated during installation. The example illustrated produces eight installations followed by the elimination of installation of four in a repetitive loop. Therefore, the skip pattern illustrated in FIG. 2 would require approximately thirty five hundred and twenty, (3520), cuts per mile of installation.

Figure 16:
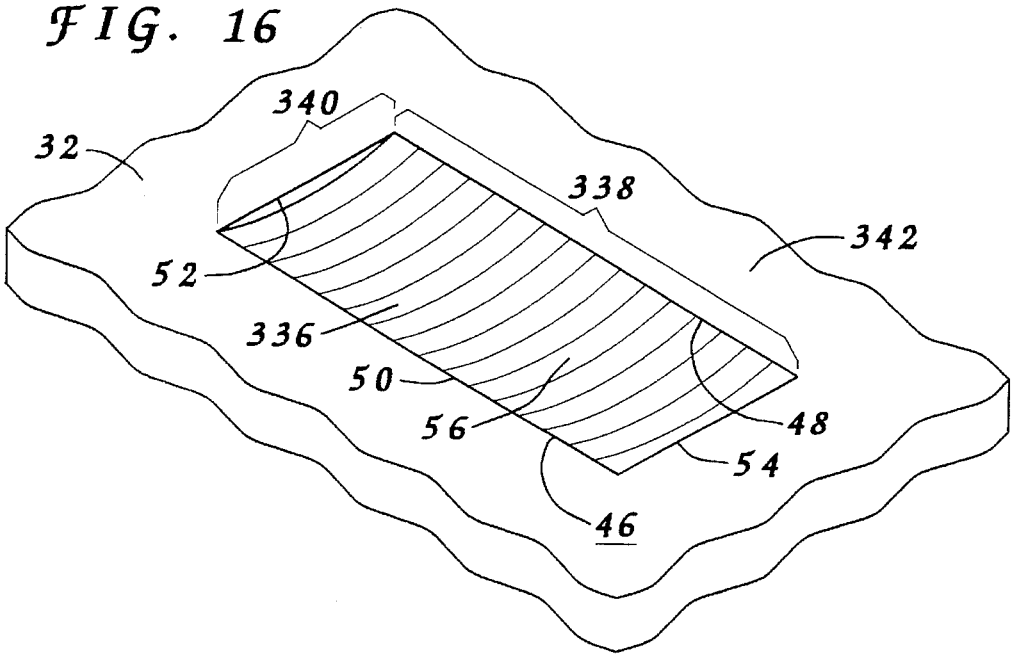
FIG. 16 is an enlarged perspective view of the SNAP type depressions shown in FIG. 1 and FIG. 2.

An enlarged view of a depression 46 is depicted in FIG. 16 and detailed below. A rotary cutting head with a diameter of approximately twenty-four inches is required for a plunge cut matching the example specifications given. Due to the milling through of each individual depression 46 a rotary cutting head with a significantly smaller diameter is utilized to practice our invention.

FIG. 3 through FIG. 6 illustrate example machines capable of performing the mill through cutting action of the instant invention. It being understood that a transport vehicle, not shown, such as a skid steer loader, would be attached to each respective machine and provide transport means and power take off means to the attached machine.

Figure 3:
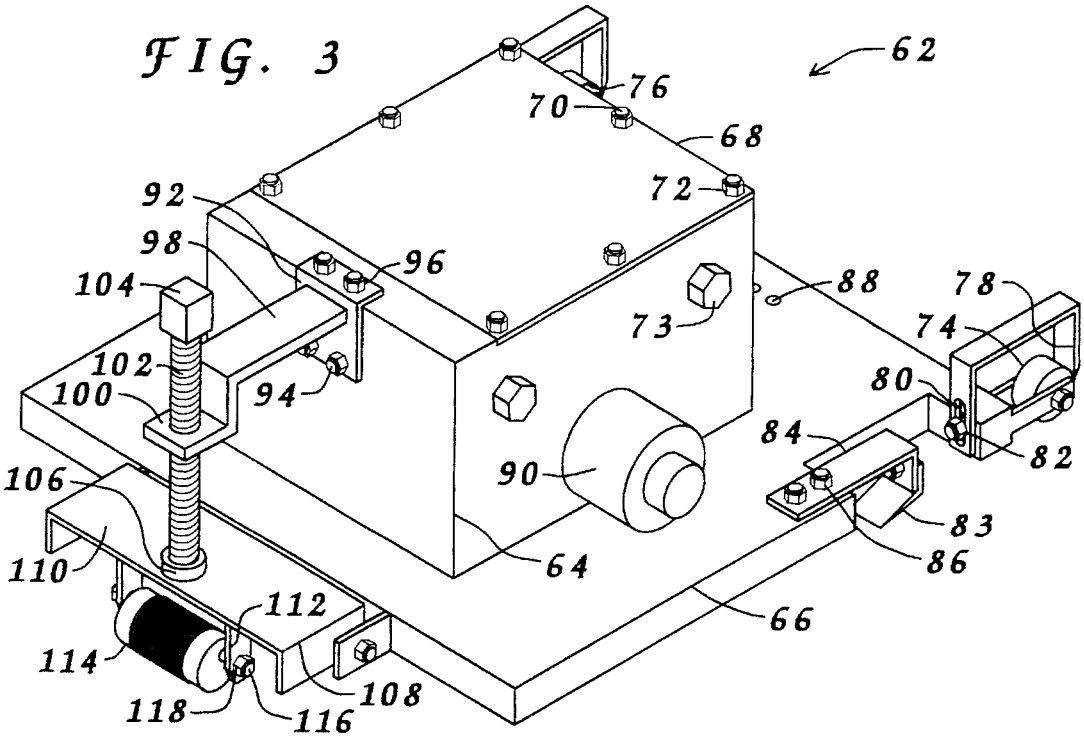
FIG. 3 is a perspective view of a cutting assembly.

FIG. 3 illustrates a cutting head assembly 62 having a cutting head enclosure 64 and an assembly support plate 66. Cutting head enclosure 64, has an entry plate 68 attached thereto utilizing a plurality of entry plate bolts 70 with corresponding entry plate nuts 72. A rotary type cutting head assembly, not shown, is contained within cutting head assembly 62. Adjustment of the vertical elevation position and the horizontal level of the rotary cutting head is facilitated by engaging various cutting head adjustment apparatuses 73. Cutting head adjustment apparatuses 73 provide for the secure placement and alignment of the rotary cutting head relative to assembly support plate 66. Cutting head enclosure 64 is securely attached to assembly support plate 66.

Securely attached to assembly support plate 66 at opposing rear corners are a first support wheel 74 and a second support wheel 76 having the purpose of permitting the rolling of cutting head assembly 62 during use. Skids are envisioned as being applicable as substitutes to the disclosed support wheels 74 and 76. Attached to each support wheel, 74 and 76, is a wheel cleaning member 78 having the purpose of preventing attachment of any debris to the wheel that would prevent contact with the true surface of the road under treatment. Wheel cleaning member 78 is attached to assembly support plate 66 at variable attachment slot 80 utilizing a connecting bolt 82. Each wheel cleaning member 78 would be adjustable, using variable attachment slot 80, relative to its respective support wheel 74 or 76.

Attached to assembly support plate 66 are opposing road clearing members 83 which would be carried along the asphalt surface of the road directly in front of its respective support wheel 74 and 76 to clear a path and ensure that support wheels 74 and 76 were in contact with the true surface of the road under treatment. Attaching road clearing member 83 to assembly support plate 66 is a connection member 84 using connection bolts 86.

Assembly support plate 66 additionally has a plurality of assembly attachment holes 88 which permit attachment to the equipment, not shown, which provide transport and drive power to cutting head assembly 62. A rotation generation apparatus 90 is provided to receive drive power in the form of hydraulic power to drive the rotary cutting head. Other power supplies, as exampled by belt drive, shaft drive or chain drive, are applicable to all the example machines shown.

An attachment plate 92 is attached to cutting head enclosure 64 using a plurality of attachment bolts 94 and a plurality of attachment nuts 96. An adjustment support 98 is attached to attachment plate 92. A shaft penetration plate 100 is attached to adjustment support 98. Penetrating shaft penetration plate 100 is an adjustment shaft 102. Adjustment shaft 102 has an adjustment connector 104 attached to its upper end and an abutting member 106 attached to its lower end.

Connected pivotally to assembly support plate 66 is a wheel assembly 108 having a wheel support plate 110 which is in contact with abutting member 106. Connected to wheel support plate 110 are two support members 112 which support a cam wheel 114. Cam wheel 114 is eccentrically penetrated by a shaft 116 and rotatable secured by opposing nuts 118. Cam wheel 114, being eccentrically penetrated by shaft 116, will roll in such a manner that shaft 116 will be forced up and down in repetitive strokes during movement.

Figure 4:
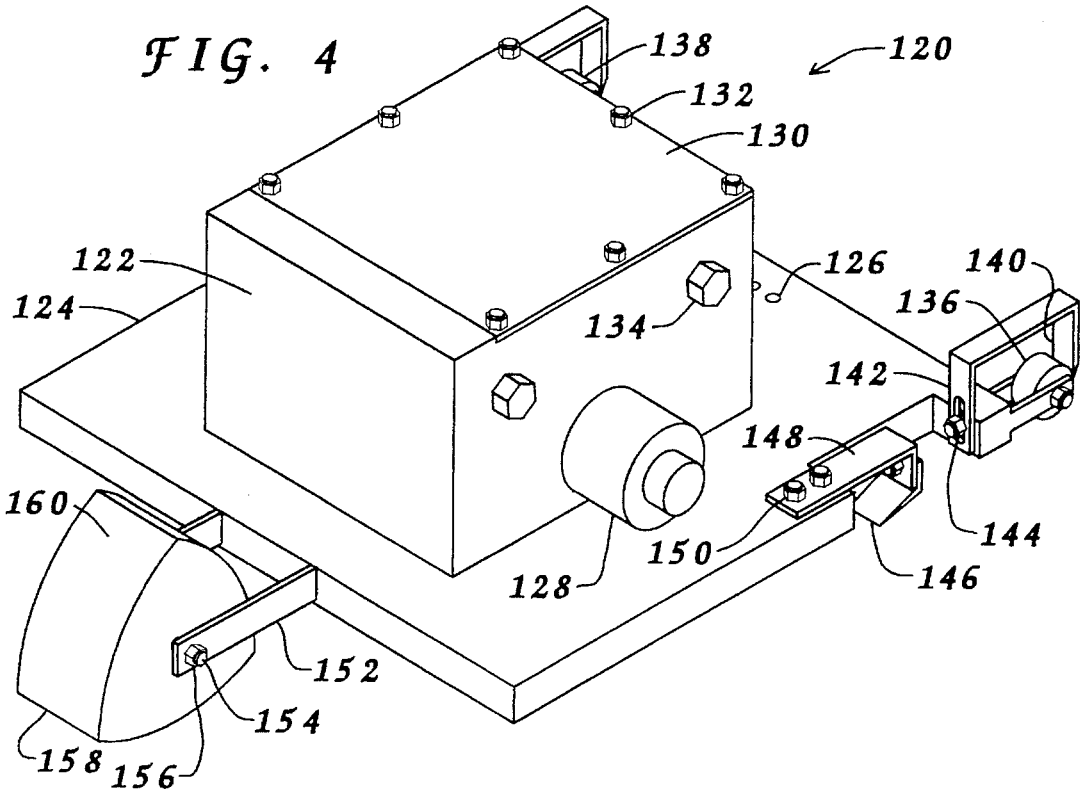
FIG. 4 is a perspective view of a second embodiment of a cutting assembly.

FIG. 4 shows a cutting tool 120 having a cutting head enclosure 122 secured to a support plate 124. Contained within cutting head enclosure 122 is a rotary cutting head, no shown, adaptable to mill asphalt. Cutting tool 120 is secured to a transport vehicle, not shown, utilizing assembly attachment holes 126. Rotary cutting head is powered to rotate by a rotation generation device 128 which receives power, such as hydraulic power, from the transport vehicle.

An entry plate 130 is secured to cutting head enclosure 122 utilizing entry plate nuts 132. Access for adjustment and routine maintenance is facilitated by removing entry plate 130. Elevational adjustment as well as horizontal leveling of the rotary cutting head relative to support plate 124 is provided for by a plurality of cutting head adjustment apparatuses 134. Such elevational adjustment and horizontal leveling affords consistent depth of cut along the lateral length of the resulting cuts.

A first support wheel 136 and a second support wheel 138 are attached to support plate 124 in opposing rearward corners. First support wheel 136 and second support wheel 138 are in constant contact with the surface under treatment during usage. A wheel cleaning member 140 is attached to support plate 124 adjacent each respective support wheel 136 and 138. Wheel cleaning member 140 is attached utilizing a variable attachment member 142 and a connecting bolt 144. Each wheel cleaning member 140 prevents accumulation of debris on the respective support wheels 136 and 138.

A road clearing member 146 is attached to support plate 124 utilizing a connection member 148 and a connection bolt 150. Each road clearing member 146 is in the path of a respective support wheel 136 and 138. Road clearing member 146 removes debris from the path of each support wheel 136 and 138, to ensure accurate tracking of the surface under treatment.

First support wheel 136 and second support wheel 138 provide a pivotal point for cutting tool 120 to be angularly pivoted upward and downward from. While the pivot point has been disclosed as being in direct communication with the surface under treatment, placement of the pivot point on the transport vehicle is equally possible.

Attached to the front of support plate 124 is a pair of support members 152 which have attached thereto a support shaft 154 utilizing bolts 156. Mounted on support shaft 154 is a cam wheel 158 having three camming groups 160. Camming groups are detailed and explained elsewhere. Support shaft 154 is the axle for cam wheel 158 and therefore is an axis line. Cam wheel 158 will be in constant contact with the surface under treatment during usage, and will rotate relative to the passage of cutting tool 120 over the surface under treatment.

As each of the three camming groups 160 pass successively over the surface under treatment, support shaft 154 will advance with the passage of cutting tool 120. Support shaft 154 will also move downward and upward depending upon the respective elevational positioning within each camming group 160. This lowering and raising of support shaft 154 will cause a pivotal elevation of cutting tool 120 relative to the pivot point formed by first support wheel 136 and second support wheel 138. As disclosed elsewhere, this will result in the rotary cutting head being brought into contact with the surface under treatment and taken out of contact with the surface under treatment in a repetitive manner to form the desired SNAP depressions.

FIG. 5 shows a cutting tool 162 containing a rotary cutting head, not shown. Rotation generation for the rotary cutting head is similar to the disclosure for FIG. 3 and FIG. 4. A cutting head enclosure 164 has an entry plate 166 secured utilizing entry plate nuts 168. Attached on opposing lateral ends of cutting head enclosure 164 are a first cam wheel 170 and a second cam wheel 172. First cam wheel 170 and second cam wheel 172 each have six matching camming groups 174.

First cam wheel 170 and second cam wheel 172 are synchronized to rotate in a matching manner utilizing a synchronizing member 176. Synchronizing member 176 comprises opposing shaft housings 178 with a connection shaft 180 attached thereto. Gears 182 are attached to the opposing ends of connection shaft 180 with engagement by chains 184. Each chain 184 extends to a gear, not shown, attached to the inner side of a shaft 186. Each shaft 186 is secured to cutting head enclosure 164 by any conventional method known in the art. First cam wheel 170 and second cam wheel 172 are each attached to their respective shaft 186 and rotatably secured thereto by a bolt 188.

First cam wheel 170 and second cam wheel 172 rotate in a corresponding manner as they transverse the surface under treatment. During such passage longitudinally along the surface under treatment, cutting head enclosure 164 will be raised and lowered by the camming action of camming groups 174 of the synchronized first cam wheel 170 and second cam wheel 172. This raising and lowering action will bring the rotary cutting head into contact and out of contact with the surface under treatment repetitively to form the desired series of SNAP depressions.

FIG. 6 shows a depression installation machine 190 which examples uniform elevation of the cutting head, not shown, to form a continuous qeries of SNAP type depressions. A housing 192, having an access cover 194 secured by bolts 196 contains the cutting head.

While numerous power transfer means exists for all of the disclosed machines including electric, internal combustion or hydraulic amongst others, a preferred embodiment is hydraulic transfer. A cutting head drive 198 receives hydraulic power transfer from a transport vehicle, not shown, and drives the cutting head. Adjustment of the cutting head is provided by a plurality of cutting head adjustments 200 which permit proper elevational adjustment as well as horizontal alignment adjustment.

Four camming members 202 are provided, with one shown removed for illustrative purposes. Each camming member 202 has three camming groups 204. All camming members 202 rotate in unison to raise and lower the machine during movement across the surface under treatment. The synchronized turning of camming members 202 is required for proper operation. Opposing axles 206 are housed in an axle housings 208 which have bearing member, not shown. A locking member 210 cooperates with a nut 212 to secure each camming member 202 to their respective axle 206. Each axle 206 has secured adjacent opposing ends a transfer sprocket 214 which receive a coupling chain 216. Thus the four camming members 202 are linked to rotate in a synchronized manner during movement.

Movement of depression installation machine 190 can be facilitated by numerous means including propulsion by a transport vehicle. A particularly expedient methods is to have depression installation machine 190 cause rotation of camming members 202 to provide for the forward motion. A drive unit 218 receives hydraulic power from the transport vehicle, converts such power, and causes the controlled rotation of a drive chain 220. Drive chain 220 is linked to a drive sprocket 222 which is rigidly secured to one axle 206.

While machines which place the cam member in direct contact with the surface under treatment have been disclosed, cam members which are detached from the surface are applicable to the invention. Control of the lowering and raising action as a result of passage across the surface under treatment is the required feature and therefore there will be communication, direct or indirect, with the surface of the road under treatment.

Adaptation of a skip pattern, as illustrated in FIG. 2, within the resultant series would be implemented by providing elevation or blocking means. The elevational or blocking means would cause the rotary cutting head to selectively not come into contact with the surface. A counting device would be linked to the machine to determine when a predetermined number of depressions had been installed. The counting device would then cause the elevation or blocking means to prevent installation during passage of a predetermined number of camming groups. Such adaptation is applicable to the machines illustrated in FIG. 3 through FIG. 6.

Throughout the numerous illustrations various cam wheel tracking lines and various rotary cutting head tracking lines are depicted. These various lines are imaginary and illustrated to explain various physical relationships of longitudinal and elevational movement of the various components. No representation to any specific physical structure is intended.

FIG. 7*a* through FIG. 13*g* depict seven examples of cam wheels, their respective rotation through one of their respective camming groups and their resulting respective cam wheel tracking lines. Specific example dimensions are given only for illustration. Each of the seven series presents longitudinal movement through one camming group with a direction of travel indicated. Each of the respective camming groups has a circumferential measurement of twelve inches matching the desired spacing of the example SNAP depression series. Therefore twelve inches of longitudinal movement is depicted through each of the series. The above mentioned seven cam wheels are shown relatively proportionally depicted. No other relative proportional relationship exists for any other cam wheels illustrated in the drawings.

Construction of the individual cam wheels would be by any of the conventional construction techniques known in the art. A specific example is given below to arrive at the sizing for the cam wheel depicted in FIG. 9*a*. Anyone with ordinary skill in the art will be capable of arriving at specific sizing of the other cam wheels illustrated as well as any of the many other sizes and shapes of possible cam wheels for specific configurations of SNAP depressions.

Figure 7A:
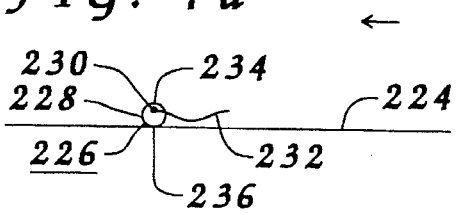
FIG. 7*a* through FIG. 7*g* are plan views of a motion series of a cam wheel.
Figure 7B:
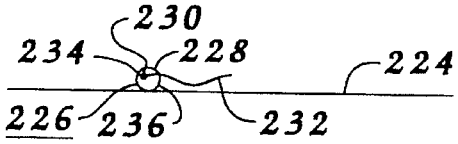
Figure 7C:
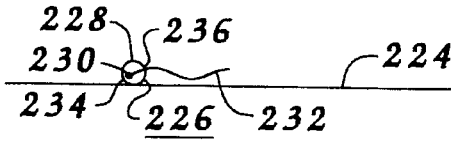
Figure 7D:
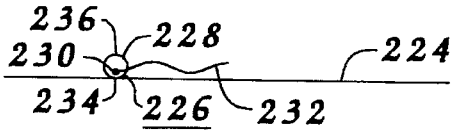
Figure 7E:
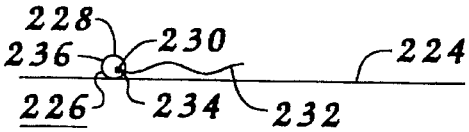
Figure 7F:
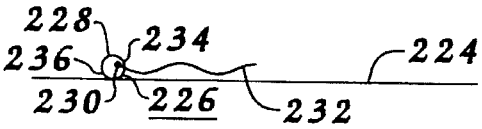
Figure 7G:
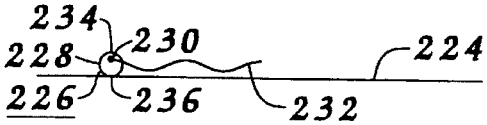

FIG. 7*a* through FIG. 7*g* depict the camming roll of a cam wheel 226 through one camming group 228. Cam wheel 226, having an offset axle 230, creates a cam wheel tracking line 232 during such motion along surface 224. Cam wheel 226 is round in shape and contains one camming group 228. Camming group 228 contains a minimum radius measurement position 234 and a maximum radius measurement position 236 with both measurements made from the center of offset axle 230. FIG. 7*a* and FIG. 7*g* place maximum radius measurement positions 236 in contact with surface 224 while FIG. 7*d* places minimum radius measurement position 234 in contact with surface 224.

Figure 8A:
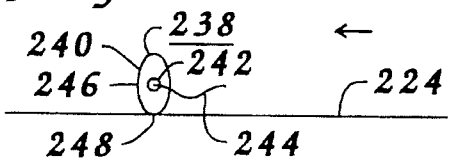
FIG. 8*a* through FIG. 8*g* are plan views of a motion series of a second embodiment of a cam wheel.
Figure 8B:
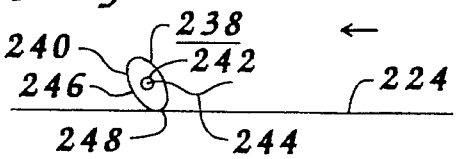
Figure 8C:
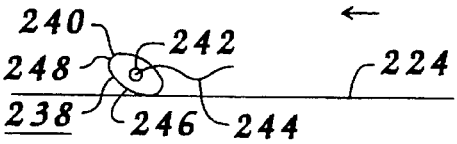
Figure 8D:
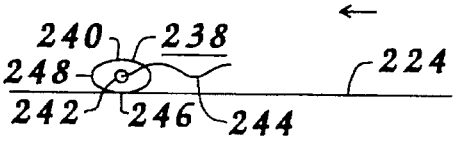
Figure 8E:
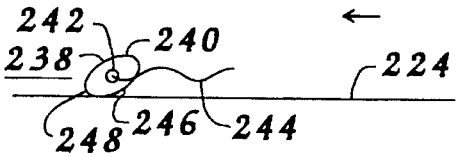
Figure 8F:
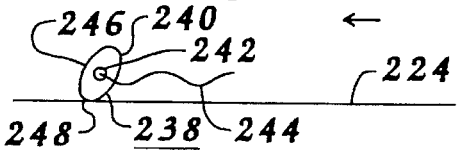
Figure 8G:
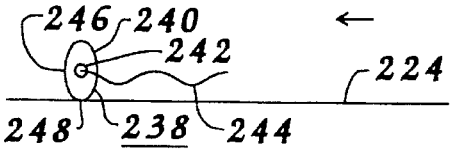

FIG. 8*a* through FIG. 8*g* depict the camming roll of a cam wheel 238 through one camming group 240. Cam wheel 238, having an axle 242, creates a cam wheel tracking line 244 during such motion along surface 224. Cam wheel 238 is oval in shape and contains two camming groups 240. Each camming group 240 contains a minimum radius measurement position 246 and a maximum radius measurement position 248 with both measurements made from the center of axle 242. FIG. 8*a* and FIG. 8*g* place maximum radius measurement positions 248 in contact with surface 224 while FIG. 8*d* places minimum radius measurement position 246 in contact with surface 224.

Figure 9A:
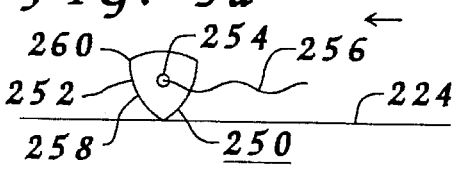
FIG. 9*a* through FIG. 9*g* are plan views of a motion series of another embodiment of a cam wheel.
Figure 9B:
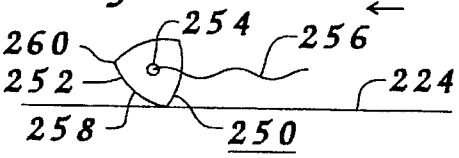
Figure 9C:
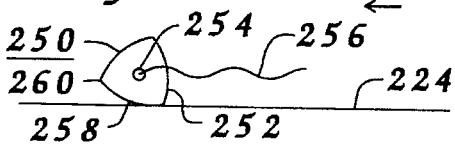
Figure 9D:
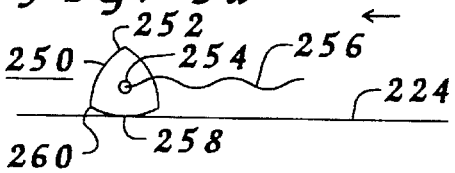
Figure 9E:
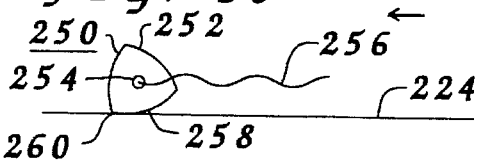
Figure 9F:
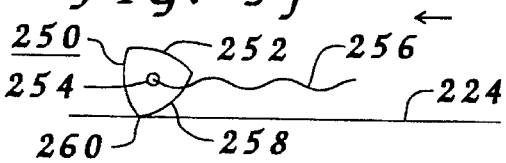
Figure 9G:
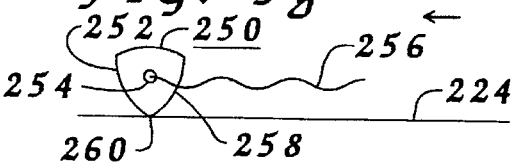

FIG. 9*a* through FIG. 9*g* depict the camming roll of a cam wheel 250 through one camming group 252. Cam wheel 250, having an axle 254, creates a cam wheel tracking line 256 during such motion along surface 224. Cam wheel 250 contains three camming groups 252. Each camming group 252 contains a minimum radius measurement position 258 and a maximum radius measurement position 260 with both measurements made from the center of axle 254. FIG. 9*a* and FIG. 9*g* place maximum radius measurement positions 260 in contact with surface 224 while FIG. 9*d* places minimum radius measurement position 258 in contact with surface 224.

Cam wheel 250 is formed of three camming groups 252 each having a circumferential measurement of twelve inches. A gradual roll through is desired in this example so a pipe having twice the circumference of the resulting cam wheel is used. Therefore, for this example, a sixty degrees span of a pipe having an approximate twenty two and nine tenths inch diameter is used. Construction of the actual cam wheel is performed by any commonly known method such as welding. An alternative method is to begin with an existing pipe having a diameter closely matching a desired resultant shape, in this example twice the desired circumference divided by pi, about 3.14159265. Simple calculations determine the circumference of the pipe. Then the desired spacing of the SNAP depressions is divided by the circumference. This calculation returns a percentage which is then multiplied by three hundred and sixty, (360), the total number of degrees in the pipe, to return a number of degrees for each of the desired sections. These sections are removed and the cam wheel is constructed as mentioned above with each section becoming a camming group.

Figure 10A:
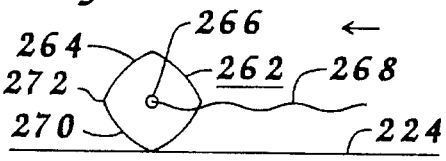
FIG. 10*a* through FIG. 10*g* are plan views of a motion series of yet another embodiment of a cam wheel.
Figure 10B:
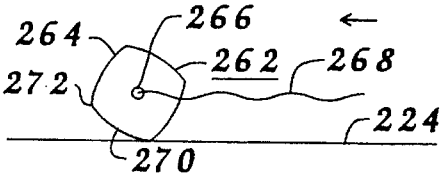
Figure 10C:
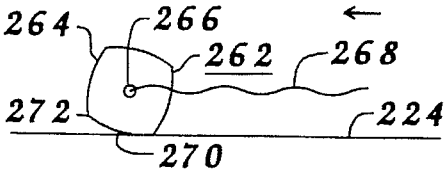
Figure 10D:
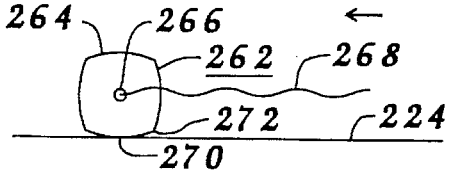
Figure 10E:
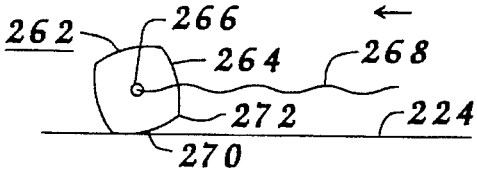
Figure 10F:
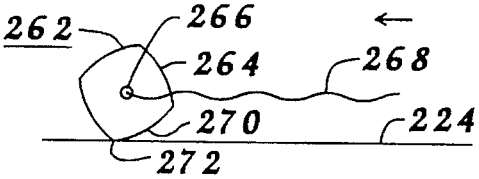
Figure 10G:
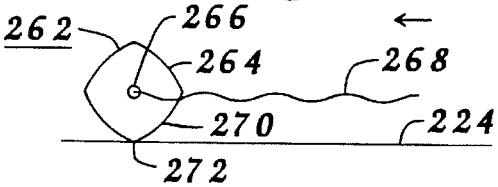

FIG. 10*a* through FIG. 10*g* depict the camming roll of a cam wheel 262 through one camming group 264. Cam wheel 262, having an axle 266, creates a cam wheel tracking line 268 during such motion along surface 224. Cam wheel 262 contains four camming groups 264. Each camming group 264 contains a minimum radius measurement position 270 and a maximum radius measurement position 272 with both measurements made from the center of axle 266. FIG. 10*a* and FIG. 10*g* place maximum radius measurement positions 272 in contact with surface 224 while FIG. 10*d* places minimum radius measurement position 270 in contact with surface 224.

Figure 11A:
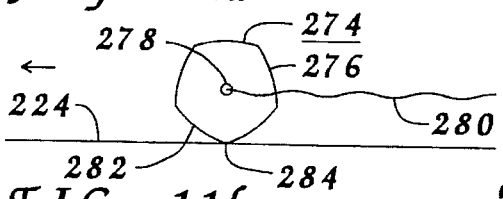
FIG. 11*a* through FIG. 11*g* are plan views of a motion series of still another embodiment of a cam wheel.
Figure 11B:
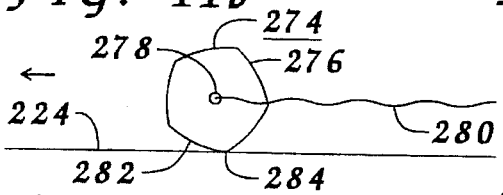
Figure 11C:
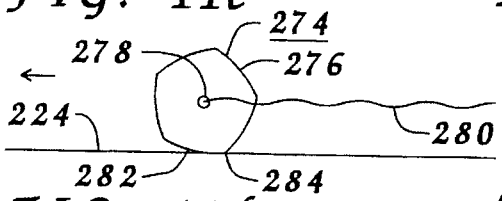
Figure 11D:
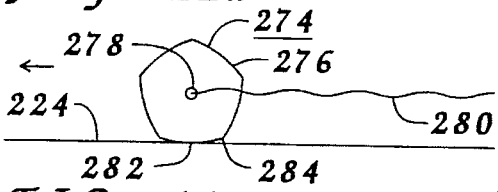
Figure 11E:
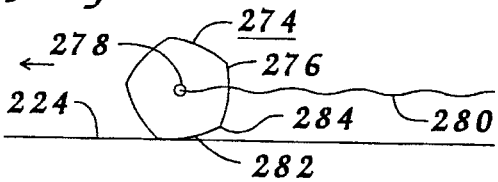
Figure 11F:
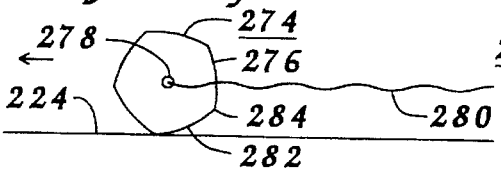
Figure 11G:
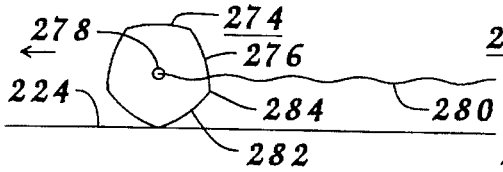

FIG. 11*a* through FIG. 11*g* depict the camming roll of a cam wheel 274 through one camming group 276. Cam wheel 274, having an axle 278, creates a cam wheel tracking line 280 during such motion along surface 224. Cam wheel 274 contains five camming groups 276. Each camming group 276 contains a minimum radius measurement position 282 and a maximum radius measurement position 284 with both measurements made from the center of axle 278. FIG. 11*a* and FIG. 11*g* place maximum radius measurement positions 284 in contact with surface 224 while FIG. 11*d* places minimum radius measurement position 282 in contact with surface 224.

Figure 12A:
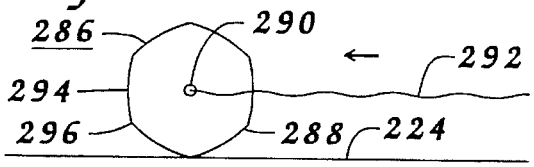
FIG. 12*a* through FIG. 12*g* are plan views of a motion series of another embodiment of a cam wheel.
Figure 12B:
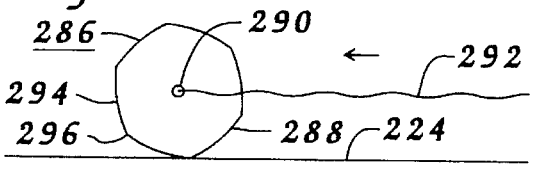
Figure 12C:
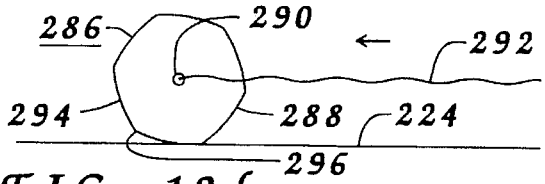
Figure 12D:
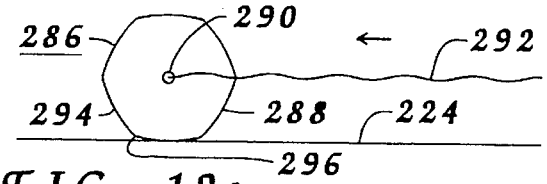
Figure 12E:
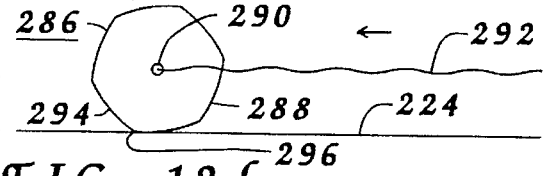
Figure 12F:
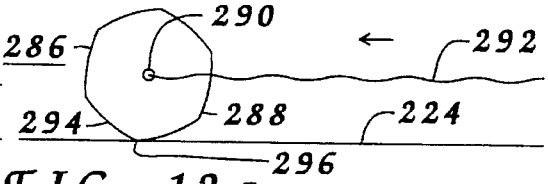
Figure 12G:
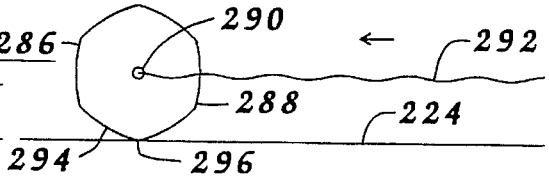
Figure 13A:
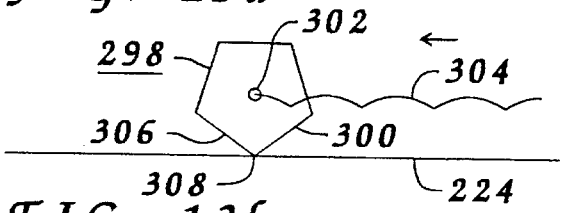
FIG. 13*a* through FIG. 13*g* are plan views of a motion series of yet another embodiment of a cam wheel.
Figure 13B:
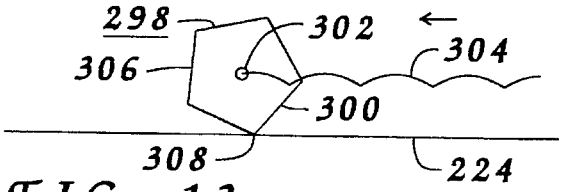
Figure 13C:
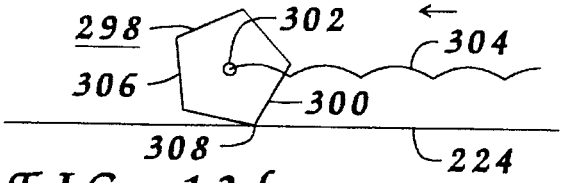
Figure 13D:
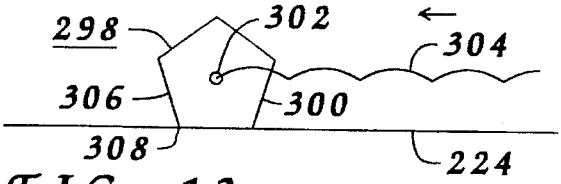
Figure 13E:
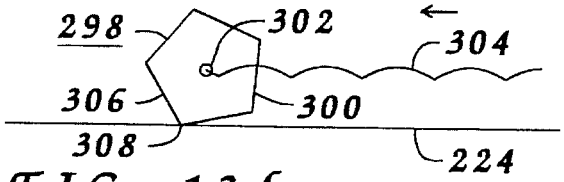
Figure 13F:
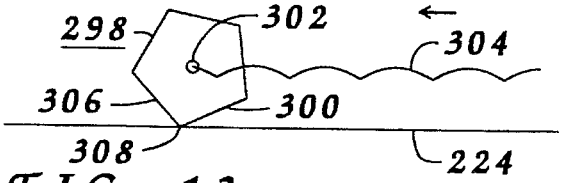
Figure 13G:
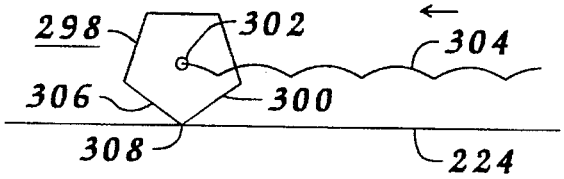
Figure 14A:
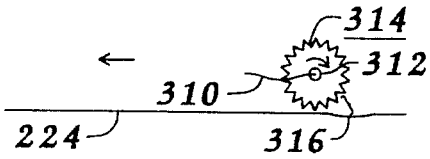
FIG. 14*a* through FIG. 14*g* are plan views of a motion series of a cutting head.
Figure 14B:
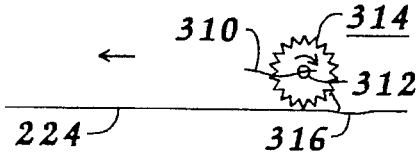
Figure 14C:
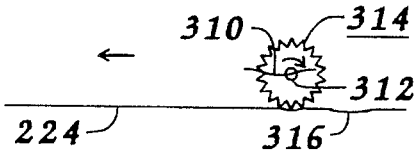
Figure 14D:
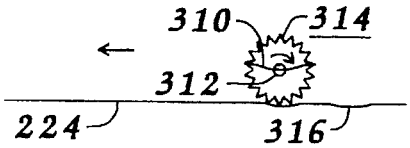
Figure 14E:
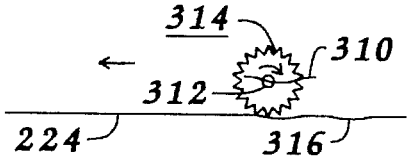
Figure 14F:
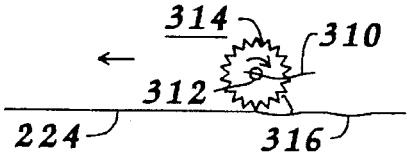
Figure 14G:
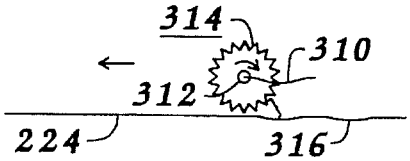
Figure 15A:
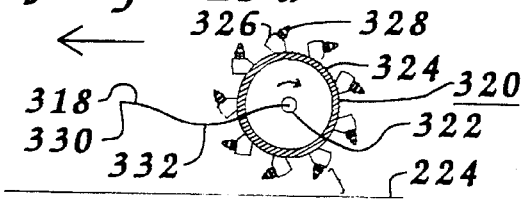
FIG. 15*a* through FIG. 15*m* are plan views of a motion series of a second embodiment of a cutting head.
Figure 15B:
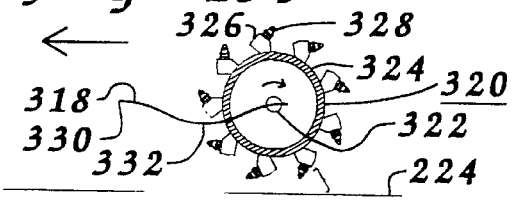
Figure 15C:
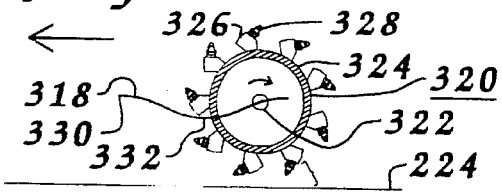
Figure 15D:
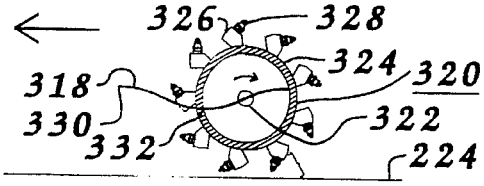
Figure 15E:
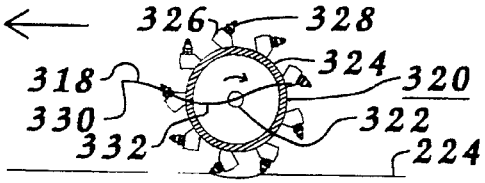
Figure 15F:
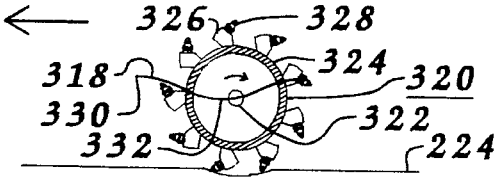
Figure 15G:
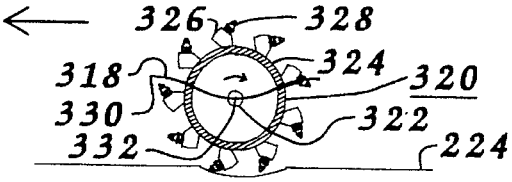
Figure 15H:
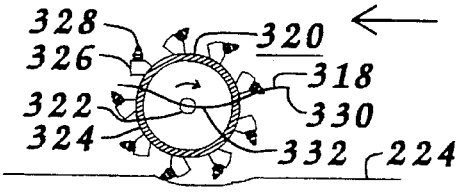
Figure 15I:
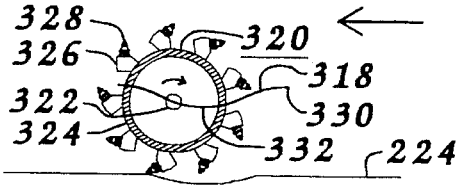
Figure 15J:
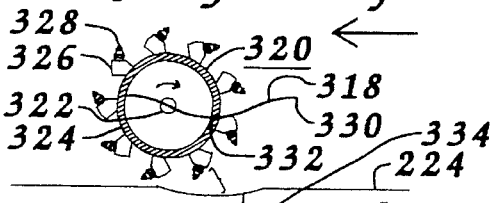
Figure 15K:
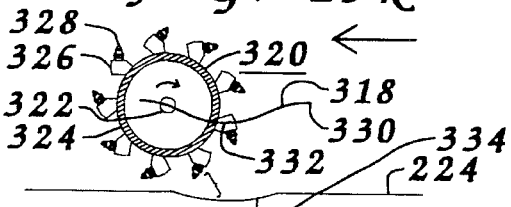
Figure 15L:
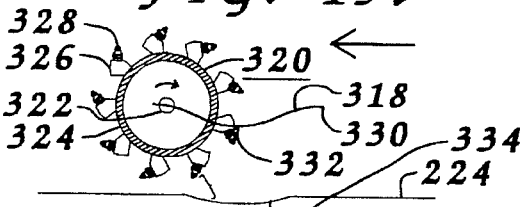
Figure 15M:
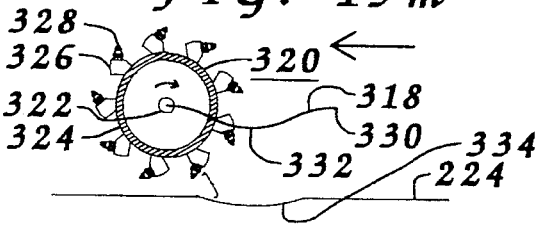

FIG. 12*a* through FIG. 12*g* depict the camming roll of a cam wheel 286 through one camming group 288. Cam wheel 286, having an axle 290, creates a cam wheel tracking line 292 during such motion along surface 224. Cam wheel 286 contains six camming groups 288. Each camming group 288 contains a minimum radius measurement position 294 and a maximum radius measurement position 296 with both measurements made from the center of axle 290. FIG. 12*a* and FIG. 12*g* place maximum radius measurement positions 296 in contact with surface 224 while FIG. 12*d* places minimum radius measurement position 294 in contact with surface 224.

FIG. 13*a* through FIG. 13*g* depict the camming roll of a cam wheel 298 through one camming group 300. Cam wheel 298, having an axle 302, creates a cam wheel tracking line 304 during such motion along surface 224. Cam wheel 298 contains five camming groups 300. Each camming group 300 contains a minimum radius measurement position 306 and a maximum radius measurement position 308 with both measurements made from the center of axle 302. All of the views within the series place maximum radius measurement positions 308 in contact with surface 224 while FIG. 13*d* places minimum radius measurement position 306 in contact with surface 224 simultaneously with maximum radius measurement position 308. This pivotally moving from consecutive maximum radius measurement positions 308 causes a sudden transition within cam wheel tracking line 304 from a downward movement to an upward movement.

FIG. 14*a* through FIG. 14*g* illustrate a transference of a cam wheel tracking line, not shown, to a rotary cutting head tracking line 310. An axle 312 of a rotary cutting head 314 receives a transference of motion from the cam wheel tracking line as disclosed elsewhere. A direction of travel is indicated as well as rotational direction of rotary cutting head 314. A depression 316 is shown installed in surface 224 with a second depression 316 being installed during completion of the series. Due to the gradual transition from downward movement to upward movement milling through of the cut is performed. Significant longitudinal movement of rotary cutting head 314 occurs while in contact with surface 224.

FIG. 15*a* through FIG. 15*m* are a series of thirteen views depicting relative movements associative with the invention. Wide variations are possible for sizing and placement of resultant depressions using the method of the invention. For illustrative purposes a series of depressions matching the example shown and described for FIG. 1 and FIG. 16 are installable from the example shown within this series.

The example depressions have a spacing, measured center to center, between each set of adjacent depressions of approximately twelve inches. Further each depressions has a longitudinal length of approximately seven inches and a center of cut having a depth of approximately one half inch, measured from the prevailing surface elevation. The depressions therefore have approximately five inches of uncut surface between each set of adjacent depressions. Accordingly a repetitive cycle repeating approximately every twelve inches of travel is shown. Also shown is an elevational range combined with descent and ascent rates sufficient to install the example depressions.

To produce depressions having the above identified sizing and spacing variations in the size of the diameter of the rotary cutting head is possible. The repetitive descent and ascent, coordinated with the forward advance, of the rotary cutting head is regulated by a camming member. As elsewhere disclosed the camming member may be indirect contact with the surface under treatment or regulated by travel across the surface. Cooperation in the combination of the diameter of rotary cutting head and repetitive cycling, including elevational range and elevational movement rates, is required to properly form the desired resultant depressions.

The production of a tracking line, as exampled by various cam wheel tracking lines, has previously been disclosed. Various examples for the transfer of the tracking line to the rotary cutting head are disclosed below.

FIG. 15*a* through FIG. 15*m* show a rotary cutting head tracking line 318 as formed by the movement of a rotary cutting head 320 relative to surface 224. Rotary cutting head tracking line 318, which is imaginary and tracks the movement of the center of an axle 322, is stationary to surface 224 throughout the various views. Rotary cutting head tracking line 318 is shown as would result from the movement of rotary cutting head 320 through one complete cycle.

Rotary cutting head 320 has a drum 324 which extends laterally of sufficient length to permit formation of properly sized depressions. The example depressions have a lateral length of approximately sixteen inches. Securely affixed to drum 324 are a plurality of symmetrically placed blocks 326 each having installed therein a bit 328, as conventionally known in the art. Axle 322 provides support for rotary cutting head 320 while permitting rotation to be imparted to drum 324. During rotation, shown by directional arrows, bits 328 form the cutting distance of rotary cutting head 320. A measurement of the diameter of rotary cutting head 320 is measured to this cutting distance.

Rotary cutting head tracking line 318 has a highest elevational measurement position 330 and a lowest elevational measurement position 332. Each successive view in the series shows approximately one inch of forward motion with the respective associative descent or ascent along rotary cutting head tracking line 318. Rotary cutting head 320 is shown at highest elevational measurement position 330 in FIG. 15*a* and FIG. 15*m*. Rotary cutting head 320 is shown at lowest elevational measurement position 332 in FIG. 15*g*.

During the decent, shown in FIG. 15*a* through FIG. 15*g*, rotary cutting head 320 comes into contact with surface 224. Following such contact with surface 224 rotary cutting head 320 moves longitudinally a significantly greater distance than a measurement of the penetration of surface 224. The penetration being approximately equal to the resultant depth of about one half inch of the formed depression 334, shown completed in FIG. 15*j* through FIG. 15*m*.

During the ascent, shown in FIG. 15*g* through FIG. 15*m*, rotary cutting head 320 comes out of contact with surface 224. While in contact with surface 224 during the ascent rotary cutting head 320 moves longitudinally a significantly greater distance than the measurement of the penetration of surface 224 during the descent.

FIG. 16 shows depression 46 as illustrated in FIG. 1 and FIG. 2, formed in asphalt 32. Depression 46 has first edge 48 and second edge 50, both being transitional edges which partially define the perimeter of depression 46 by tapering downward gradually from a surrounding surface elevation 342. Forming of depression 46 occurs as a rotary cutting head, not shown, passes from first edge 48 to second edge 50. During such forming the lateral extends of the rotary cutting head form first side 52 and second side 54. Both sides 52 and 54 are relatively sharp edges and combine with edges 48 and 50 to define the perimeter of depression 46. A cut surface 336 forms and defines depression 46. Asphalt material is cut away by rotary cutting head to form depression 46.

Dimensioning of depression 46 is measured by a longitudinal length 340, a lateral length 338 and a depth to the deepest part, being center of cut 56. Longitudinal length 340 is measured from first edge 48 to second edge 50. Depth is measured at center of cut 56, the deepest part of depression 46, measured horizontally to the plane of surrounding surface elevation 342 of asphalt 32. Lateral length 338 is measured from first side 52 to second side 54.

Figure 19A:
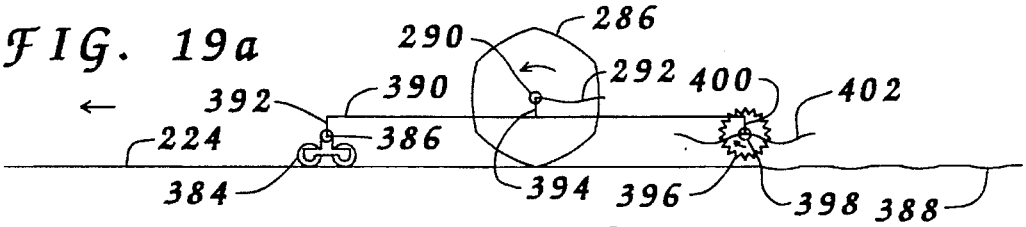
FIG. 19*a* through FIG. 19*c* are plan views of a motion series of a support assembly, a cam wheel and a rotary cutting head showing a second transfer method.
Figure 19B:
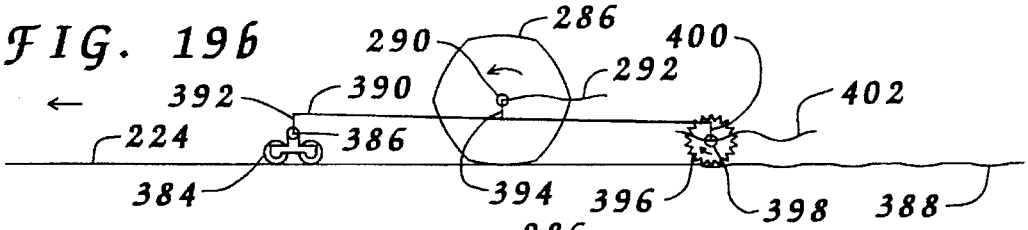
Figure 19C:
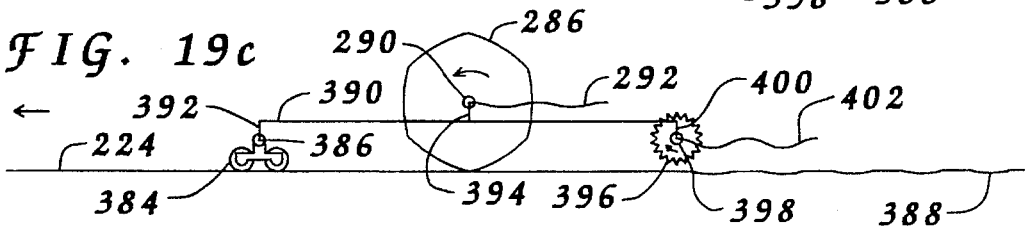
Figure 20A:
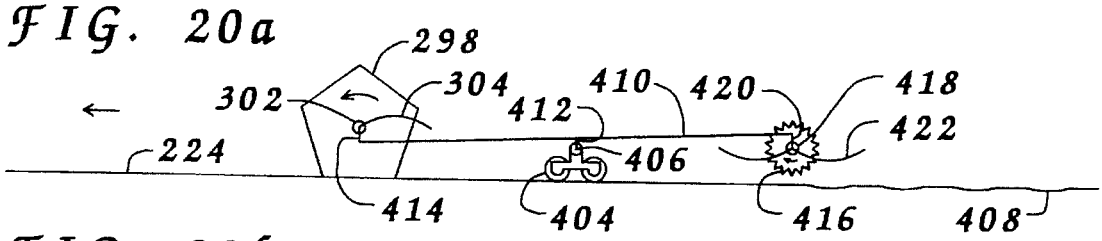
FIG. 20*a* through FIG. 20*c* are plan views of a motion series of a cam wheel, a support assembly and a rotary cutting head showing a third transfer method.
Figure 20B:
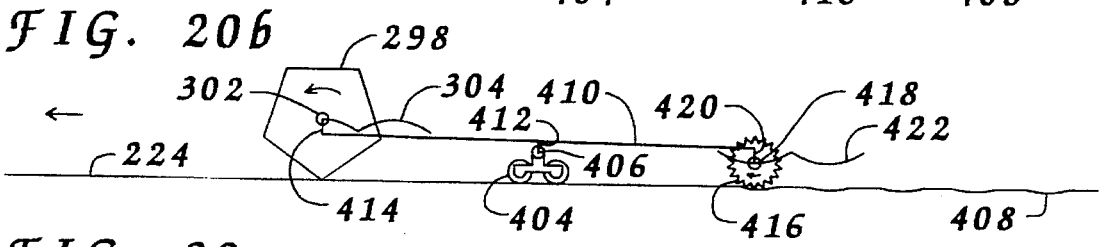
Figure 20C:
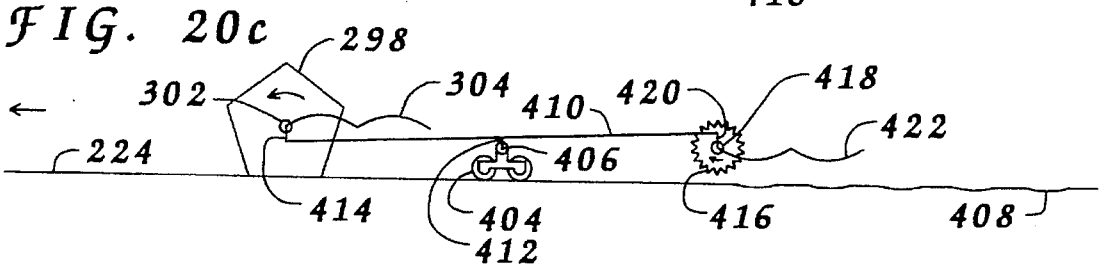
Figure 21A:
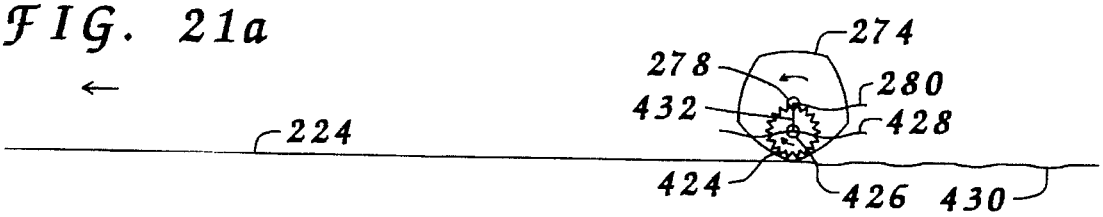
FIG. 21*a* through FIG. 21*c* are plan views of a motion series of a cam wheel and a rotary cutting head showing a fourth transfer method.
Figure 21B:
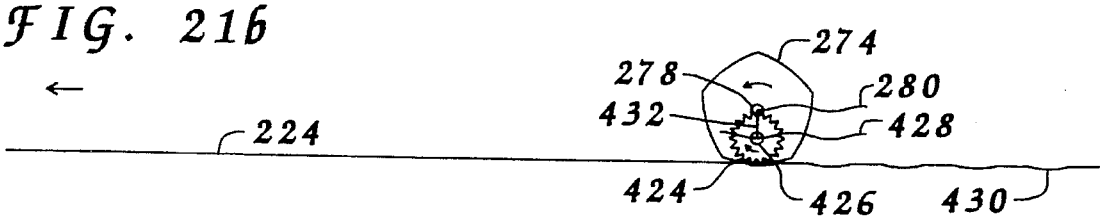
Figure 21C:
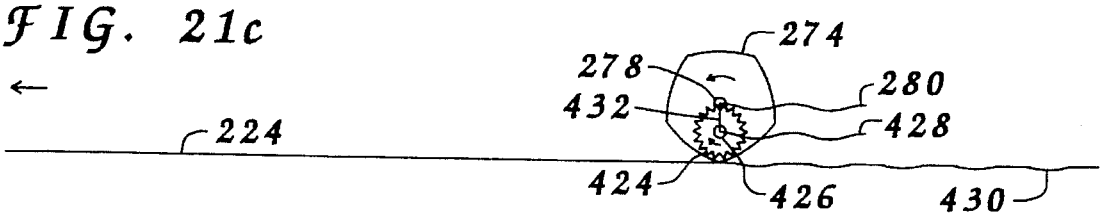

FIG. 17*a* through FIG. 21*c* illustrate several of the methods to transfer the respective cam tracking lines to the various rotary cutting heads. FIG. 17*a* through FIG. 17*c* and FIG. 18*a* through FIG. 18*c* depict the direct transfer of a lesser proportion of the respective cam tracking line. FIG. 19*a* through FIG. 19*c* depict the direct transfer of a greater proportion of the cam tracking line. FIG. 20*a* through FIG. 20*c* depict a reverse transfer of a variable proportion, either lesser or greater, of the cam tracking line. FIG. 21*a* through FIG. 21*c* depict the direct transfer of a relatively equal proportion of the cam tracking line.

Figure 17A:
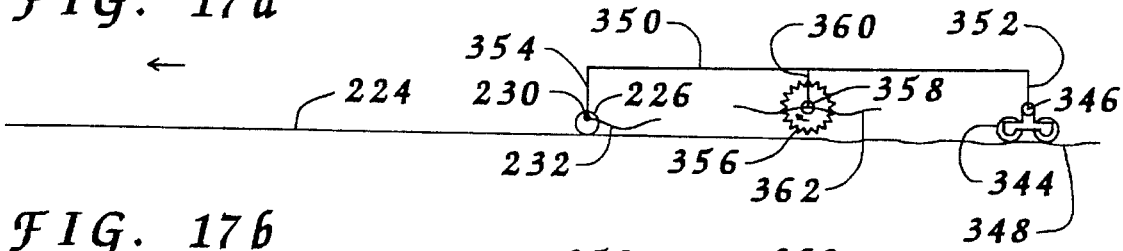
FIG. 17*a* through FIG. 17*c* are plan views of a motion series of a cam wheel, a rotary cutting head and a support assembly showing a first transfer method.
Figure 17B:
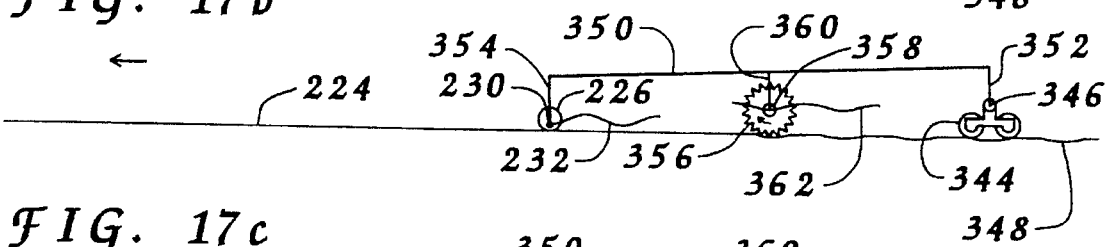
Figure 17C:
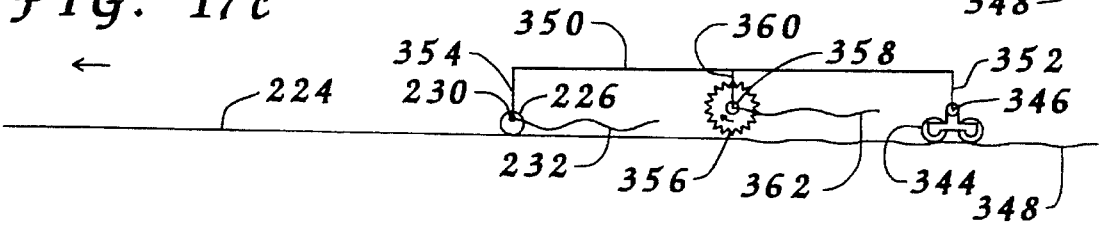

FIG. 17*a* through FIG. 17*c* illustrate a cam wheel having a single camming group. Cam wheel 226, illustrated in FIG. 7*a* through FIG. 7*g* and more particularly described above, has offset axle 230 which moves longitudinally due to the advancing roll of cam wheel 226. During this longitudinal advance offset axle 230 is repetitively moved upward and downward. This movement is depicted by cam wheel tracking line 232.

A support assembly 344 is shown in direct contact with surface 224. A pivot point 346 is therefore in direct communication with surface 224 and remains a relatively consistent elevation to surface 224. Support assembly 344 would remain outside of depressions 348 formed in surface 224 and therefore would consistently track surface 224. A transfer line 350 connects pivot point 346, using a support extension 352, and offset axle 230, using a cam wheel extension 354.

A rotary cutting head 356 has an axle 358 which is connected to transfer line 350 utilizing a cutting head extension 360. The camming roll of cam wheel 226 causes transfer line 350 to transfer to rotary cutting head 356 a proportional amount of the elevational motion represented within cam wheel tracking line 232. This transference is represented as a cutting head tracking line 362 and results in the formation of depressions 348.

The proportional amount transferred depends primarily upon the relationship of axle 358 of rotary cutting head 356 to both offset axle 230 of cam wheel 226 and pivot point 346 of support assembly 344. When axle 358 of rotary cutting head 356 is midpoint between these two points, approximately one half of the elevational range of cam wheel tracking line 232 is transferred. When axle 358 of rotary cutting head 356 is closer to offset axle 230 of cam wheel 226 than to pivot point 346 of support assembly 344 a greater proportion of the elevational range of cam wheel tracking line 232 is transferred. When axle 358 of rotary cutting head 356 is closer to pivot point 346 of support assembly 344 than to offset axle 230 of cam wheel 226 a lesser proportion of the elevational range of cam wheel tracking line 232 is transferred.

Figure 18A:
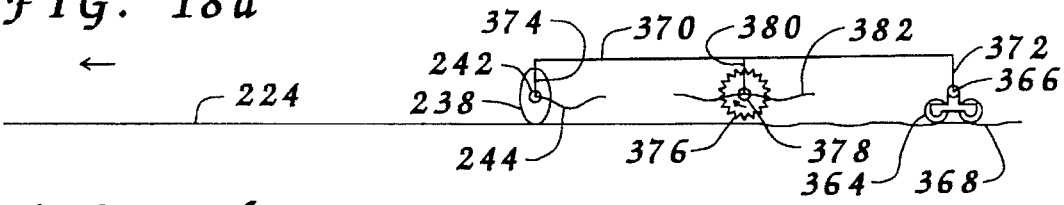
FIG. 18*a* through FIG. 18*c* are plan views of a motion series of a second embodiment of a cam wheel with a rotary cutting head and a support assembly showing the first transfer method.
Figure 18B:
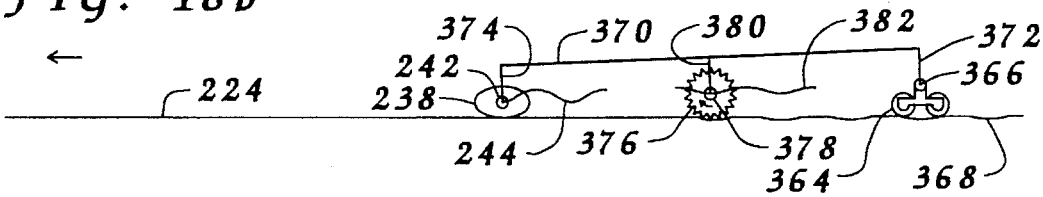
Figure 18C:
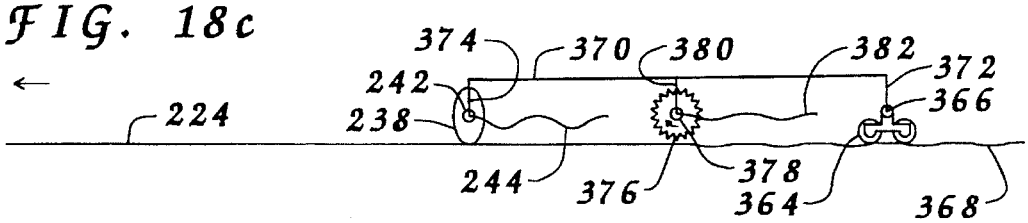

FIG. 18*a* through FIG. 18*c* illustrate use of a cam wheel having a plurality of camming groups. Cam wheel 238, illustrated in FIG. 8*a* through FIG. 8*g* and more particularly described above, has axle 242 which moves longitudinally due to the advancing roll of cam wheel 238. During this longitudinal advance axle 242 is repetitively moved upward and downward. This movement is depicted by cam wheel tracking line 244.

A support assembly 364 is shown in direct contact with surface 224. A pivot point 366 is therefore in direct communication with surface 224 and remains a relatively consistent elevation to surface 224. Support assembly 364 would remain outside of depressions 368 formed in surface 224 and therefore would consistently track surface 224. A transfer line 370 connects pivot point 366, using a support extension 372, and axle 242, using a cam wheel extension 374.

A rotary cutting head 376 has an axle 378 which is connected to transfer line 370 utilizing a cutting head extension 380. The camming roll of cam wheel 238 causes transfer line 370 to transfer to rotary cutting head 376 a proportional amount of the elevational motion represented within cam wheel tracking line 244. This transference is represented as a cutting head tracking line 382 and results in the formation of depressions 368.

The proportional amount transferred is generally the same as disclosed above for FIG. 17*a* through FIG. 17*c*.

FIG. 19*a* through FIG. 19*c* show cam wheel 286, illustrated in FIG. 12*a* through FIG. 12*g* and more particularly described above. Cam wheel 286 has axle 290 which moves longitudinally due to the advancing roll of cam wheel 286. During this longitudinal advance axle 290 is repetitively moved upward and downward. This movement is depicted by cam wheel tracking line 292.

A support assembly 384 is shown in direct contact with surface 224. A pivot point 386 is therefore in direct communication with surface 224 and remains a relatively consistent elevation to surface 224. A transfer line 390 connects pivot point 386, using a support extension 392, and axle 290, using a cam wheel extension 394.

A rotary cutting head 396 has an axle 398 which is connected to transfer line 390 utilizing a cutting head extension 400. The camming roll of cam wheel 286 causes transfer line 390 to transfer to rotary cutting head 396 a greater proportional amount of the elevational motion represented within cam wheel tracking line 292. This transference is represented as a cutting head tracking line 402 and results in the formation of depressions 388.

The proportional amount transferred is variable depending primarily upon the relational spacing between pivot point 386 of support assembly 384 and axle 290 of cam wheel 286 and between axle 290 of cam wheel 286 and axle 398 of rotary cutting head 396. When axle 290 of cam wheel 286 is midpoint between pivot point 386 of support assembly 384 and axle 398 of rotary cutting head 396 approximately twice the elevational range of cam wheel tracking line 292 is transferred to cutting head tracking line 402. When axle 290 of cam wheel 286 is closer to pivot point 386 of support assembly 384 a greater exaggeration of the elevational range of cam wheel tracking line 292 is transferred to cutting head tracking line 402. When axle 290 of cam wheel 286 is closer to axle 398 of rotary cutting head 396 a lesser exaggeration of the elevational range of cam wheel tracking line 292 is transferred to cutting head tracking line 402.

FIG. 20*a* through FIG. 20*c* show cam wheel 298, illustrated in FIG. 13*a* through FIG. 13*g* and more particularly described above. Cam wheel 298 has axle 302 which moves longitudinally due to the advancing roll of cam wheel 298. During this longitudinal advance axle 302 is repetitively moved upward and downward. This movement is depicted by cam wheel tracking line 304.

A support assembly 404 is shown in direct contact with surface 224. A pivot point 406 is therefore in direct communication with surface 224 and remains a relatively consistent elevation to surface 224. A transfer line 410 connects pivot point 406, using a support extension 412, and axle 302, using a cam wheel extension 414.

A rotary cutting head 416 has an axle 418 which is connected to transfer line 410 utilizing a cutting head extension 420. The camming roll of cam wheel 298 causes transfer line 410 to transfer to rotary cutting head 416 a reverse representation of cam wheel tracking line 304. This transference is represented as a cutting head tracking line 422 and results in the formation of depressions 408. This reverse transfer is proportionally variable.

The proportional amount transferred is variable depending primarily upon the relational spacing the various components with all transfers being a reversal of cam wheel tracking line 304. The relational spacing is between axle 302 of cam wheel 298 and pivot point 406 of support assembly 404 and axle 418 of rotary cutting head 416. When pivot point 406 of support assembly 404 is midpoint between axle 302 of cam wheel 298 and axle 418 of rotary cutting head 416 approximately the same elevational range of cam wheel tracking line 304 is transferred to cutting head tracking line 422. When axle 302 of cam wheel 298 is closer to pivot point 406 of support assembly 404 a greater amount of the elevational range of cam wheel tracking line 304 is transferred to cutting head tracking line 422. When axle 418 of rotary cutting head 416 is closer to pivot point 406 of support assembly 404 a lesser amount of the elevational range of cam wheel tracking line 304 is transferred to cutting head tracking line 422.

FIG. 21*a* through FIG. 21*c* show cam wheel 274, as illustrated in FIG. 11*a* through FIG. 11*g*, directly transferring motion to a rotary cutting head 424 during the camming roll. A second cam wheel 274 would support rotary cutting head 424 on the opposing lateral end of rotary cutting head 424. An axle 426 of rotary cutting head 424 is longitudinally aligned with axle 278 of cam wheel 274 using an extension 432. Elevational relationship may vary depending upon the selection of cam wheel and the diameter of the cutting head selected. Cam wheel 274 creates a camming roll during longitudinal advance as depicted by cam wheel tracking line 280. A cutting head tracking line 428 depicts the movement of rotary cutting head 424. Rotary cutting head 424 causes formation of a depression 430 when rotary cutting head 424 comes into contact with surface 224. Longitudinal milling through of each depression 430 is performed.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling with the scope of the invention.

We claim:

1. A method of milling a depression into a road surface, the method comprising the steps of;

a) providing a rotary cutting tool;

b) positioning the rotary cutting tool over the road surface;

c) lowering the rotary cutting tool into contact with the road surface;

d) advancing the rotary cutting tool longitudinally forward while the rotary cutting tool remains in contact with the road surface, while;

e) simultaneously gradually lowering the rotary cutting tool, then;

f) gradually raising the rotary cutting tool, while;

g) simultaneously continuing to advance the rotary cutting tool longitudinally forward while remaining in contact with the road surface;

h) continuing to raise the rotary cutting tool out of contact with the road surface;

whereby the rotary cutting tool is advanced while in contact with the road surface during the gradual lowering and advanced while still in contact with the road surface during the gradual raising to form a milled through cut depression.

2. The method defined in claim 1 wherein the rotary cutting tool further includes elevational regulatory means to regulate timing of the lowering and raising of the rotary cutting tool during the advance while in contact with the road surface.

3. The method defined in claim 2 wherein the elevational regulatory means comprises a cam member, the cam member providing a repetitive cycling of a lowering action and a raising action, the lowering action and the raising action regulated by the advance of the rotary cutting tool.

4. The method defined in claim 3 wherein the cam member comprises a cam wheel, the cam wheel in direct contact with the road surface, the cam wheel rotating as a result of the advance of the rotary cutting tool, the cam wheel having at least one camming group, each camming group providing for a transfer of the rotary cutting tool from a beginning elevational height through an elevational cycle and returning to the beginning elevational height, the elevational cycle having a minimum elevational height and a maximum elevation height, the minimum elevational height and the maximum elevational height both relative to the road surface, the minimum elevational height placing the rotary cutting tool in contact with the road surface, the maximum elevational height placing the rotary cutting tool elevated above the road surface the beginning elevational height being the maximum elevation height.

5. The method defined in claim 4 wherein the cam wheel provides one elevational cycle per one complete rotation of the cam wheel across the road surface during the advance of the rotary cutting tool, the one complete rotation of the cam wheel causing milling of one depression.

6. The method defined in claim 4 wherein the cam wheel provides a plurality of elevational cycles per one complete rotation of the cam wheel across the road surface during the advance of the rotary cutting tool, the one complete rotation of the cam wheel causing milling of a number of depressions equal to the number of elevational cycles per one complete rotation of the cam wheel.

7. The method defined in claim 1 further comprising repeating steps c through h in a repetitive manner with the addition of the step of advancing the rotary cutting tool longitudinally a predetermined distance while out of contact with the road surface included between each repetition of steps c through h, whereby a series of milled depressions are formed.

8. A method of continuously milling a series of depressions in a surface of a road, the surface of the road having a prevailing plane at a location of placement of each depression within the series of depressions, the method comprising the steps of;

a) providing a cutting tool, the cutting tool capable of milling the surface of the road, the cutting tool having a lateral width;

b) advancing the cutting tool continually along a desired path, the desired path along the surface of the road;

c) providing elevation regulation means, the elevation regulation means to transfer a lowering action and a raising action to the cutting tool in a repetitive cycle, during each of the cycles of the repetitive cycle the cutting tool comes into contact with the surface of the road during the lowering action and the cutting tool comes out of contact with the surface of the road during the raising action, the lowering action having a beginning contact line on the surface of the road, the raising action having an ending contact line on the surface of the road, the distance between the beginning contact line and the ending contact line having a distance measurement, the lowering action placing the cutting tool at a maximum penetration line prior to beginning the raising action, the maximum penetration line having a distance measurement from the prevailing plane of the surface of the road, the distance measurement between the beginning contact line and the ending contact line significantly greater than the distance measurement of the maximum penetration line to the prevailing plane of the surface of the road;

whereby the cutting tool advances a significantly greater distance longitudinally while in contact with the surface than the distance of penetration of the surface by the cutting tool during forming of each depression within the series.

9. The method defined in claim 8 wherein the elevation regulation means comprises a cam wheel, the cam wheel in contact with the surface of the road and rotating based on passage along the surface of the road, the cam wheel capable of transferring to the cutting tool the lowering action and the raising action.

10. The method defined in claim 9 wherein the cam wheel provides one elevational cycle per one complete rotation of the cam wheel across the surface of the road during the advance of the cutting tool, the one complete rotation of the cam wheel causing milling of one depression.

11. The method defined in claim 9 wherein the cam wheel provides a plurality of elevational cycles per one complete rotation of the cam wheel across the surface of the road during the advance of the cutting tool, the one complete rotation of the cam wheel causing milling of depressions equal to the number of elevational cycles per one complete rotation of the cam wheel.

12. A machine to form a series of depressions in a surface of an a road during continuous longitudinal advance of the machine, the depressions longitudinally aligned in the series along a desired path, each depression having a curved base, the curved base having an extended diameter measurement, the machine comprising;

a) a rotary cutting head, the rotary cutting head capable of milling the surface of the road, the rotary cutting head having a cutting diameter measurement, the cutting diameter measurement being less than the extended diameter measurement of the curved base of the depression;

b) regulation means, the regulation means to transfer to the rotary cutting head an elevational movement, the elevational movement imparting a lowering action and a raising action to the rotary cutting head, the rotary cutting head coming into contact with the surface of the road during the lowering action, the rotary cutting head penetrating the surface of the road during the lowering action, the rotary cutting head coming out of contact with the surface of the road during the raising action, the rotary cutting head advancing longitudinally while in contact with the surface of the road during both the lowering action and the raising action, the regulation means causing a repetitive transference of the elevational movement to the rotary cutting head to form the series of depressions;

whereby the regulation means transfers a repetitive transference of elevational movements to the rotary cutting head to cause the lowering action and the raising action to form a depression while the rotary cutting head is in contact with the surface of the road, the rotary cutting head longitudinally advancing while the rotary cutting head is in contact with the surface of the road during forming of each depression within the series of depressions.

13. The machine defined in claim 12 wherein the regulation means comprises a cam wheel, the cam wheel in contact with the surface of the road and rotating based on passage along the surface of the road, the cam wheel having at least one camming group, each camming group having a first position during rotation placing the rotary cutting head at a maximum elevational position and a second position during rotation placing the rotary cutting head at a minimum elevational position, the maximum elevational position placing the rotary cutting head out of contact with the surface of the road, the minimum elevational position placing the rotary cutting head penetrating the surface of the road.

14. The machine defined in claim 13 further comprising a pivot point and a connection member, the connection member connecting the rotary cutting head, the cam wheel and the pivot point, the pivot point cooperating with the cam wheel to transfer the elevational movement to the rotary cutting head.

15. The machine defined in claim 14 further comprising an axle, the axle penetrating the cam wheel, the axle connected to the connection member; and wherein the first position of each camming group placing the axle at a highest elevational position, the second position of each camming group placing the axle at a lowest elevational position; whereby a direct transference of elevational motion is transferred from the cam wheel to the rotary cutting head.

16. The machine defined in claim 14 further comprising an axle, the axle penetrating the cam wheel, the axle connected to the connection member; and wherein the first position of each camming group placing the axle at a lowest elevational position, the second position of each camming group placing the axle at a highest elevational position; whereby a reverse transference of elevational motion is transferred from the cam wheel to the rotary cutting head.

17. The machine defined in claim 13 further comprising a second cam wheel, the second cam wheel matching the cam wheel, the cam wheel and the second cam wheel linked to rotate side by side, parallel and spaced positioning in a synchronized manner; and wherein the rotary cutting head has a lateral length is carried between the cam wheel and the second cam wheel with opposing lateral ends of the rotary cutting head each adjacent one cam wheel; whereby the rotary cutting head is supported on opposing lateral ends by the cam wheel and the second cam wheel.

* * * * *